United States Patent [19]

Eason

[11] 4,004,312

[45] Jan. 25, 1977

[54] SURFACE WASHING TOOL

[75] Inventor: Donald Eason, Chicago, Ill.

[73] Assignee: Lawrence Peska Associates, Inc., New York, N.Y. ; a part interest

[22] Filed: Apr. 5, 1976

[21] Appl. No.: 673,725

[52] U.S. Cl. ..... 15/29

[51] Int. Cl.[2] ..... A46B 13/06

[58] Field of Search ..... 15/23, 24, 28, 29, 97 R, 15/98, 50 R

[56] References Cited

UNITED STATES PATENTS 1,369,567 2/1921 Smith ..... 15/29

3,114,164 12/1963 Riordan ..... 15/29

*Primary Examiner*—Edward L. Roberts

*Attorney, Agent, or Firm*—Eugene V. Mandel

[57] ABSTRACT

A surface washing tool including a tubing element affixed to a garden hose or the like, a housing affixed to the tubing element and a brush member rotatably affixed within the housing. A valve means directs the flow of water from the tubing element out the bottom of the housing and against the brush member imparting rotation thereto.

6 Claims, 4 Drawing Figures

SURFACE WASHING TOOL

BACKGROUND OF THE INVENTION

1. Field of the Invention

The present invention relates to cleaning tools, and more particularly, to a washing tool using a flow of water and a brush means.

2. Description of the Prior Art

Several cleaning operations such as the washing of concrete surfaces and swimming pool walls are best effected by the employment of a constant stream of water coupled with a brushing action. The prior art includes several types of water jets and nozzles some including a brush means. These brush means are fixed in position and the user must impart a scrubbing action thereto in order to effect cleaning.

The present invention provides a brush means that is adapted to rotate using a water flow for powering the same thereby providing a scrubbing action without any effort by the user.

SUMMARY OF THE INVENTION

Therefore, it is a primary object of the present invention to provide a surface washing tool which includes brush means powered by a water flow therethrough.

A further object of the present invention is to provide a surface washing tool with rotating brush means which may be activated or deactivated easily by the user.

A still further object of the present invention is to provide a surface washing tool which is easily maneuvered by the user on the surface to be cleaned.

These objects, as well as further objects and advantages, of the present invention will become readily apparent after reading the description of a non-limiting illustrative embodiment and the accompanying drawing.

A surface washing tool according to the principles of the present invention includes a hollow open ended housing forming a chamber and a hole disposed in the closed side thereof opposite the open end, the chamber having a ridge affixed to the walls thereof parallel to the closed side; a round brush member rotatily disposed within the chamber having a central opening therein, a passage from the central opening out through the lower surface thereof and a groove disposed in the side of the chamber, the groove adapted to slideably cooperate with the ridge, the brush member also including a plurality of bristles affixed to the lower surface thereof and a plurality of fin elements radially disposed projecting outwardly from the central hole and affixed to the upper surface of the brush member; a tubing element affixed on one end to the housing over the hole, the tubing having an aperture concentrically aligned with the hole, the tubing element is sealed on the other end and means for affixing a hose to communicate fluids thereto; and a valve means having a tunnel therethrough adapted to be slideably retained within the hole, the opening and the aperture, the tunnel being adapted to communicate fluids from the tubing element to the passage with the valve in the down position and adapted to spray the fluids within the tubing element against the fin elements of the brush members imparting rotation thereto with the valve in the up position.

BRIEF DESCRIPTION OF THE DRAWINGS

In order that the present invention may be more fully understood it will now be described, by way of example, with reference to the accompanying drawings in which.

DESCRIPTION OF THE PREFERRED EMBODIMENT

Figure 1:
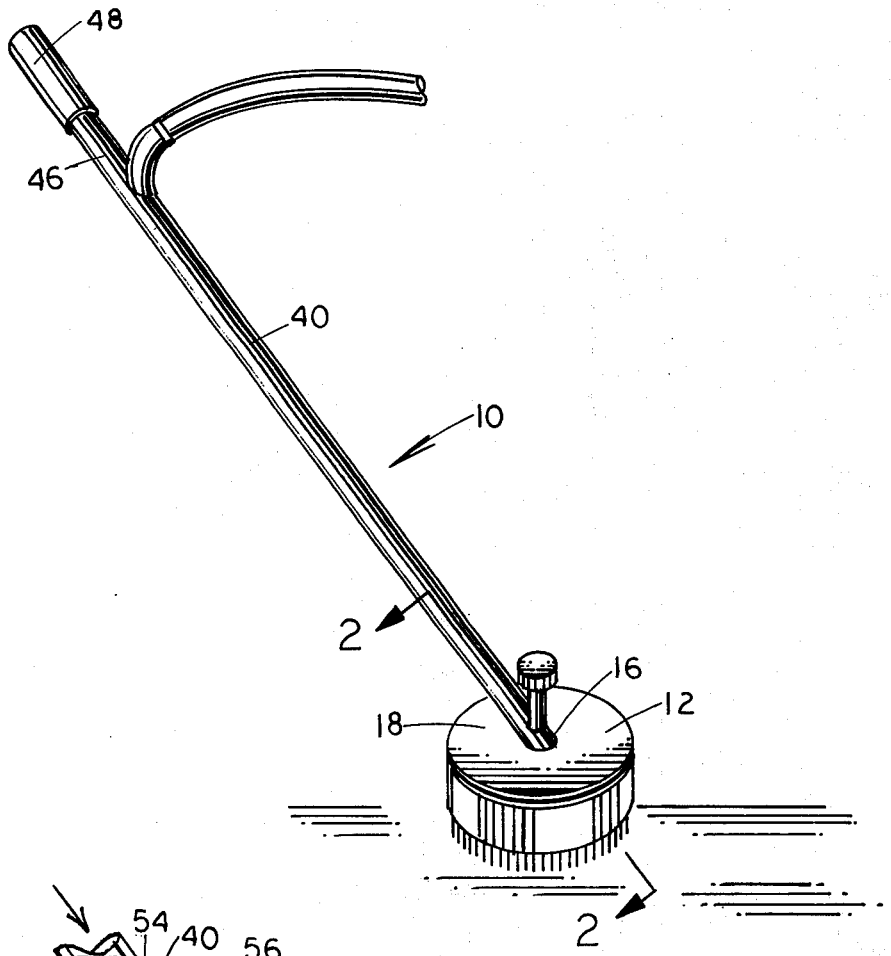
FIG. 1 illustrates a pictorial representation of the preferred embodiment of the present invention.
Figure 2:
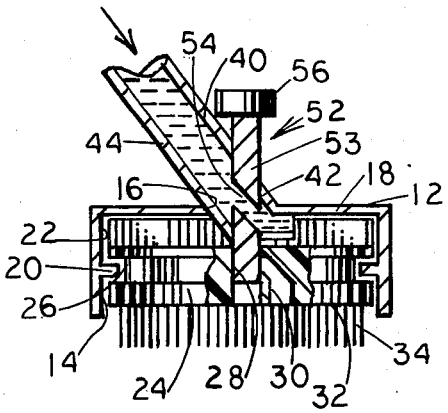
FIG. 2 illustrates a sectional view of the preferred embodiment taken substantially along the line 2—2 of FIG. 1.

Referring now to the figures, and more particularly to FIG. 1 there is illustrated therein the preferred embodiment of the present invention, a surface washing tool 10 including a hollow open ended housing 12. The hollow open ended housing 12 is preferably circular in shape and forms a chamber 14 therein. A hole 16 is disposed in the closed side 18 thereof. A ridge 20 is affixed to the walls 22 of the chamber 14 parallel to the closed side 18 as shown in FIG. 2.

Figure 3:
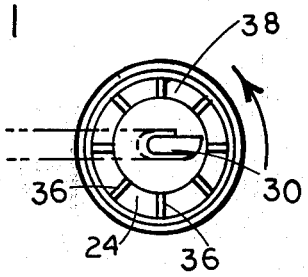
FIG. 3 illustrates a top view of the brush member.

A round brush member 24 having a groove 26, is rotatibly disposed within the chamber 14 with the groove 16 and the ridge 20 adapted to slideably cooperate. The round brush member 24 also includes a central opening 28 and a passage 30 from the central opening 28 to the lower surface 32 of the brush member 24. A plurality of bristles 34 are affixed to the lower surface 32 and a plurality of fin elements 36 are radially disposed on the upper surface 38 projecting outwardly from the central opening 28 as shown in FIG. 3.

A tubing element 40 having an aperture 42 in a free end 44 thereof is affixed to the housing 12 with the aperture 42 concentrically aligned with the hole 16. The tubing element 40 is sealed on the other free end 46 and preferably includes a handle portion 48. Means for affixing a hole to communicate fluids to the tubing element 40 in the form of a standard male threaded plumbing fitting 50.

Figure 4:
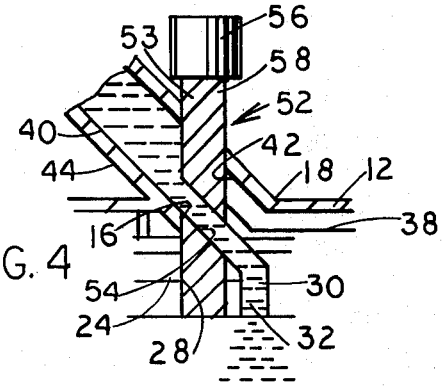
FIG. 4 illustrates a sectional view of the valve means.

A valve means 52 in the form of a shaft 53 having a tunnel 54 therethrough is adapted to be slideably retained within the hole 16, the opening 28, and the aperture 42. The tunnel 54 is adapted to communicate fluids from the tubing element 40 to the passage 30 when the shaft 53 is in the down position as shown in FIG. 4 and to communicate fluids from the tubing element 40 to spray on the fin elements 36 of the brush member 24 imparting rotation thereto as shown in FIG. 2. A knob portion 56 is preferably affixed to the end 58 of the shaft 53.

The tubing element 40 is preferably constructed of aluminum and the housing 12 and brush member 24 of plastic. The bristles 34 are preferably constructed of nylon and are distributed in groups in a symmetrical pattern.

It will be understood that various changes in the details, materials, arrangements of parts and operation conditions which have been herein described and illustrated in order to explain the nature of the invention may be made by those skilled in the art within the principles and scope of the invention.

Having thus set forth the nature of the invention, what is claimed is:

1. A surface washing tool comprising:

a. a hollow open ended housing forming a chamber therein, said housing having a hole disposed in the closed end thereof said chamber being provided with a ridge in the walls thereof parallel to said closed side;

b. a round brush member rotatably disposed within said chamber having a central opening therein, a passage from said central opening out through the lower surface thereof, and a groove disposed in the sides of said member, said groove adapted to slideably cooperate with said ridge, said brush member also including a plurality of bristles affixed to the lower surface thereof and a plurality of fin elements affixed to the upper surface of said brush member;

c. a tube element affixed on one end over said hole to said housing, said tubing element having an aperture concentrically aligned with said hole, said tubing element being sealed on the other end and means for affixing a hose to said tubing element for communicating fluids therethrough; and d. a valve means having a tunnel suitable for fluids therethrough adapted to be slideably retained within said hole, said opening, and said aperture, said tunnel adapted to pass fluids from said tubing element with said tunnel in the down position and adapted to spray said fluids from said tubing element against said fin elements of said brush member imparting rotation thereto.

2. The surface washing tool according to claim 1, wherein said sealed end of said tubing element includes a handle portion.

3. The surface washing tool according to claim 1, wherein said affixing means comprises a male threaded plumbing fitting.

4. The surface washing tool according to claim 1, wherein said valve means includes a knob portion on the upper end thereof.

5. The surface washing tool according to claim 1, wherein said housing is circular in shape.

6. The surface washing tool according to claim 1, wherein the valve means is adapted to at least three positions comprising a closed position to preclude the passage of fluids, a brush rotation position as described in claim 1, and a bypass position in which the fluids are directed through the brush unit without necessarily rotating the brush.

* * * * *